United States Patent [19]

Meshberg

[11] 4,441,634

[45] Apr. 10, 1984

[54] DISPENSER ADAPTED FOR FAST PRESSURE FILLING

[76] Inventor: Philip Meshberg, 2500 S. Ocean Blvd., Palm Beach, Fla. 33480

[21] Appl. No.: 339,046

[22] Filed: Jan. 13, 1982

[51] Int. Cl.[3] ..... B65D 83/14; G01F 11/02

[52] U.S. Cl. ..... 222/402.16; 222/402.24; 141/3; 141/20

[58] Field of Search ..... 222/402.1, 402.16, 402.18, 222/402.24, 402.25, 518, 321, 383, 385, 394, 400.7, 402.2; 141/3, 20

[56] References Cited

U.S. PATENT DOCUMENTS

| | | | |
|---|---|---|---|
| 2,974,453 | 3/1961 | Meshberg | 53/29 |
| 3,096,003 | 7/1963 | Nesin | 222/402.16 |
| 3,473,704 | 10/1969 | O'Donnell | 222/402.16 |
| 3,651,997 | 3/1972 | Venus, Jr. | 222/402.16 |
| 3,674,185 | 7/1972 | Evesque | 222/402.16 |
| 3,797,748 | 3/1974 | Nozawa et al. | 222/321 |
| 4,271,875 | 6/1981 | Meshberg | 222/402.16 |

FOREIGN PATENT DOCUMENTS 1287126 8/1972 United Kingdom .

*Primary Examiner*—Joseph J. Rolla
*Assistant Examiner*—Michael S. Huppert
*Attorney, Agent, or Firm*—Kenyon & Kenyon

[57] ABSTRACT

A pressurized dispenser which includes a container, a mounting cup with a central opening attached thereto, a dispenser having a body member forming a tank and an open top portion, a dispensing stem projecting through the central opening, the body retained in the mounting cup, and a diaphragm interposed between the body and the mounting cup sealing around the projecting stem. The body member forms a chamber having a diameter smaller than the diameter of the tank axially inward of the tank, to form a bottom in the tank at the point where the chamber begins. At least one hole is formed in the bottom radially outward of the chamber forming a path to the inside of the container. A piston-like member inserted into the tank extending to its bottom has a flange extending axially inward terminting in a sealingly lip sealing against the side of the tank at the bottom and an annular portion axially inward of the sealing edge forming a throat, with the valve stem extending through the throat. A cylindrical member concentric with the flange is sealed to and extends inwardly from the throat and engages the inner chamber in a sealing manner so as to seal off the annular space between the flange and the cylindrical member, this space being in communication with the hole permitting, during pressure filling, the flexing of the sealing lip away from the side of chamber to permit flow through the hole into the container.

6 Claims, 3 Drawing Figures

DISPENSER ADAPTED FOR FAST PRESSURE FILLING

BACKGROUND OF THE INVENTION

This invention relates to pressurized dispensers in general and more particularly to a dispenser construction which permits increased speed in pressure filling.

Generally, pressurized containers comprise a can or bottle containing the material to be dispensed along with a pressurizing fluid, either an aerosol valve, or a pump, and a mounting cup by means of which the valve or pump is mounted on top of the can or bottle. Generally, in a valve type arrangement, there is pressure filling with a liquid propellent, whereas in a pump type arrangement, nitrogen or compressed gas is used. Typically, in a valve type arrangement an aerosol valve is crimped onto the mounting cup with a diaphragm disposed between the top of the valve body and the mounting cup. This diaphragm seals around the valve stem, which is depressed downward for dispensing, along with sealing at the top of the valve body.

In general, two types of aerosol valves are in common use. These are a metering valve and a non-metering valve. The construction of the metering valve is such that a chamber is formed in the valve body. The chamber is of a size to hold a metered dose of the product to be dispensed. When the valve is in an unoperated position, the tank formed in the valve body is placed in communication with a dip tube extending to the bottom of the can and the tank is filled with the product to be dispensed under pressure. Upon the depression of the valve stem, the inlet from this dip tube and, thus from the container, is closed off and an outlet through the upper part of the stem is then opened. The material under pressure in the tank is forced out through the dispensing outlet. In a non-metering valve, on the other hand, the tank is always in communication with the dip tube and thus with the container. As a result, depressing the valve to place the outlet in communication with the tank provides for a continuous supply of material to be dispensed.

Generally, there are two methods of getting the propellent into the container. One type is cold filling in which the propellent is maintained in liquid condition by being cooled and is filled into the container in that manner. This, of course, requires special refrigeration equipment to maintain the container and the propellent at a low temperature until the mounting cup and the valve therein can be crimped in place on top of the container. Cold filling is not at all practical in some cases. For example, when using hydrocarbon propellents, which have become more common due to the problems caused by fluorocarbons, cold filling presents significant dangers. Because a certain amount of the propellent will escape during cold filling, a collection of hydrocarbon such as butane in the air can result and can cause an explosive danger.

The other method of filling is known as pressure filling. In this method of filling, the propellent is forced into the container, generally through the dispensing outlet in the valve stem. The rate of dispensing from the valve is normally controlled by an orifice or outlet port in the stem. Generally, this orifice is small. This places a limit on the filling rate. A further problem exists, particularly in a metering valve, since when the valve is depressed, at which time it would be possible to force the material under pressure through the valve stem and into the tank, the tank is sealed off at the bottom. One solution to this problem has been to place a cross-cut in the stem which, if the valve is depressed further than it would be in normal operation, bridges the seal at the bottom of the tank to permit the material to flow from the tank and into the container. This solution although workable is still slow because of limitations on the size of the orifice and it requires a more complex construction of the valve stem.

Another manner of pressure filling is disclosed in U.S. Pat. No. 2,974,453. In this arrangement, a two piece stem is used. By using a two piece stem, interchangeable upper stem portions become possible. Thus, a stem with a port at its lower end is used for pressure filling, whereas a stem with a port further up is used for dispensing. This, of course, results in increased complexity of the aerosol valve.

A further solution is that disclosed in British Pat. No. 1,287,126. In this arrangement for pressure filling, openings are made at the top of the valve body at the edges. Normally these holes are covered by the sealing ring or diaphragm at the top of the valve body by means of which the valve is sealed to the mounting cup. In this method of pressure filling the material under pressure, after it reaches the tank, forces its way under the sealing ring and finds its way to the holes whereupon it reaches the container. Although this works reasonably well, there are still limitations on filling speed. In the valve disclosed in the British patent, the valve body is made of metal. A similar construction has been used with plastic. However, in each case the design is such that under normal conditions a seal is formed between the valve body and the mounting cup at the top of the valve body. Some sort of seal is necessary in order to prevent the material under pressure of the propellent from escaping. However, this method of pressure filling is still relatively slow.

Another solution is disclosed in my U.S. Pat. No. 4,271,875. In the arrangement therein rather than simply having holes or slots at the edge of the valve body, slots formed in the top of the valve body are always in communication, at their inner ends, with the tank or pump chamber. The slots in the top of the pump body are connected to openings which run the length of the pump body, being formed as slots in its outer surface or as holes passing through the pump body, forming channels which extend from the tank to the gasket between the mounting cup and the container. Thus, the diaphragm overlying the tank, and which is between the tank and the mounting cup, no longer seals the top of the tank to the mounting cup. This diaphragm still, however, seals around the valve stem except during pressure filling. To obtain the additional sealing which is necessary, the gasket which surrounds the valve body and which is disposed between the mounting cup and the top of the container is utilized. The gasket is made to closely fit around the valve body. To a certain extent this gasket acts like a check valve. Because it is supported over a larger area on its top portion by the mounting cup than it is supported against the top of the container, during pressure filling, the medium, i.e., the propellent, entering through the slots in the top of the valve body coming into contact with the gasket pushes it away from the side of the valve body opening a path through which the medium can flow. However, under normal conditions with normal pressure in the container, the gasket remains in place against the sides of the container and prevents the propellent and product from flowing past it.

Although this arrangement works quite well, it does require maintaining relatively close tolerances in certain areas in order to get the required sealing, for example, between the gasket and the valve body. Furthermore, as is noted in the aforesaid patent, the valve body must be smooth and the opening or hole in the gasket must match the housing quite closely or else leakage can occur.

Thus, it is the object of the present invention to provide a simple construction which permits fast pressure filling for either a metered or non-metered type aerosol valve and which does not rely upon a pressure filling path through the entrance orifice to the valve which in many cases is a small limiting aperture, and which also does not require the close tolerances of using a gasket around the body as a check valve.

SUMMARY OF THE INVENTION

In accordance with the present invention, to solve this problem, a valve body forms a tank having a number of openings in the bottom thereof for the purpose of pressure filling. An inner chamber is formed by the body radially inward and axially inward of the bottom of the tank. This chamber contains the entrance from a dip tube into the tank area and supports the dip tube. Inserted into the tank is a piston-like member which includes a tail piece which makes sealing contact with the inner chamber and which also seals against the walls of the tank to seal off the pressure filling openings in the bottom of the tank. The piston-like member is flexible and is adapted to give under conditions of pressure filling so as to flex away from the sides of the tank to allow access to the openings in the bottom of the tank to permit the pressurizing gas to flow from the tank through these openings into the container thereby bypassing the limited inlet orifice to the tank. If the valve is to be a metering valve, a seal is formed at an inner opening in the piston, through which material flows from the inner chamber into the tank chamber between the opening and the valve stem. In a non-metering valve, there is a clearance between the valve stem and the opening through the piston so that continuous flow is possible.

DETAILED DESCRIPTION OF THE INVENTION

Figure 1:
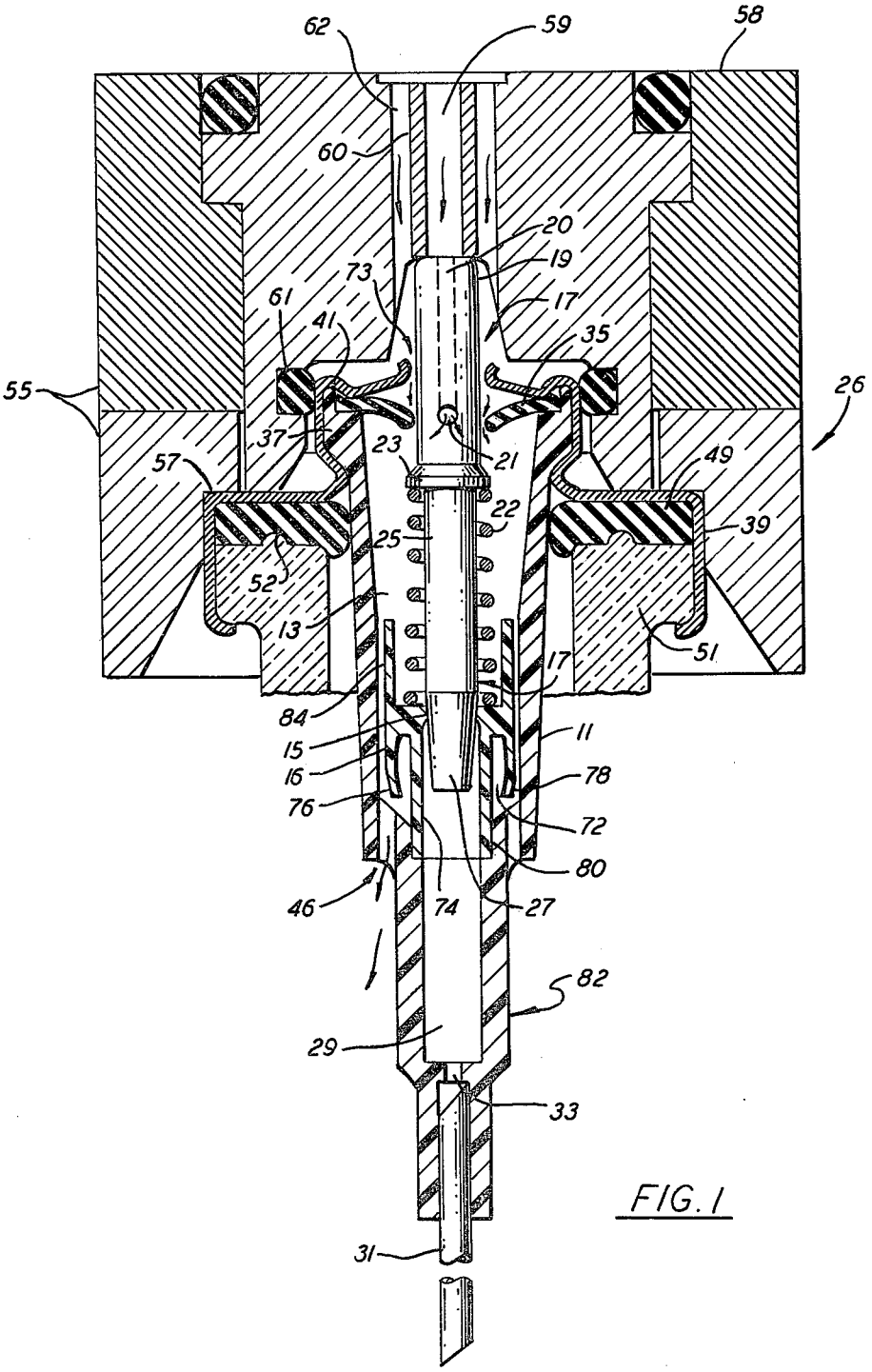
FIG. 1 is a cross-sectional view of a metering valve according to the present invention showing the valve in the pressure filling position with the pressure filling head disposed thereover.

FIG. 1 is a cross-sectional view of a metering valve and mounting cup constructed according to the present invention. The valve includes a valve body 11 in which there is formed a tank 13 of predetermined capacity to permit metering a predetermined amount of material. Movably disposed within the tank and sealing against a throat 15 is a valve stem 17. Throat 15 is formed in a piston-like member generally designated as 16 to be described in more detail below. The valve stem 17 includes an upper portion 19 containing an axial bore 20 which communicates with a radial port or orifice 21. A flange 23 is formed directly below the upper portion 19 of the valve stem. The valve stem has a lower portion 25 which extends through the tank 13 and the bottom of which seals against the sealing throat 15 during operation. A spring 22 acts between the bottom of tank 13 and flange 23 to bias stem 17 outward. The valve is shown in the pressure filling position, with a pressure filling head disposed thereover. In this position, tapered portion 27 of stem 17, formed at the very bottom of the stem portion 25, is below the throat 15 preventing communication between a chamber 29 below the throat, which is itself in communication with a dip tube 31 through an orifice 33.

A diaphragm 35 surrounds the top portion of the stem 19. The valve, which has an enlarged portion 37 at its top is crimped into a mounting cup 39. The diaphragm 35 is disposed between mounting cup 39 and the top of the valve body 11. The diaphragm 35 is received in a recessed area in the top of the valve body defined by an annular wall 41.

The piston-like member 16 forming the throat 15 is inserted into and rests against the bottom of the tank 13 above the chamber 29. Formed at the bottom of the tank 13 are outlet passages 46 in communication with the container to which the valve is attached. These communicate with an annular space 72. The annular space 72 is defined between a cylindrical inwardly extending portion 74 of the member 16 and a concentric flange 76 surrounding the cylindrical portion 74. At the end of the flange 76 is a sealing surface 78, which seals against the inside of the tank under normal circumstances. Normally, when pressure filling is not taking place, pressure within the space 72 will force the flange 76 against the wall of the tank 13 with the sealing portion 78 sealing thereagainst. The cylindrical portion 74 is inserted in and seals against a cylindrical bore 80 formed in a tail piece extension 82 of the tank body 11 in which the chamber 29, limiting orifice 33 and an opening for supporting dip tube 31 are found.

Member 16 also has an upper flange portion 84 which has an diameter smaller than the inside diameter of tank 13. As a result, during pressure filling, the pressurizing medium can flow around the flange 84 to reach the area directly above the contact surfaces 78 causing the lower flange portion 76 to deflect inwardly to permit flow past the sealing area 78 into the openings 46. Thus, in the present invention, material flows from the tank 13 around the member 16, deflecting the lower flange 76 and through the holes 46 into the container. The mounting cup 39 and valve are crimped onto a container 51 with an appropriate seal, i.e., the mounting cup is sealed to the container, such as by means of a gasket 49.

Pressure filling head 26 is of conventional design and only the portions of interest to the present invention will be discussed. Basically, the pressure filling head has an outer portion 55 with a step 57 adapted to rest on the top of the mounting cup 39 when the pressure filling head is moved into position. Inserted within the outer portion 55 is an inner portion 58 containing a central opening 59 formed by a tubular member 60 through which the pressure filling fluid is supplied. The opening 59 is in alignment with the bore 20 in the stem 17. Surrounding tubular member 60 is an annular space 62. This central portion includes a sealing ring 61 which seals around the upper portion of the mounting cup 39 when the filling head is in place. The tubular member 60 in the inner portion 58 of the filling head presses down on the valve stem 17 moving the port 21 below the diaphragm 35. In the normal, at rest position, as will be evident from examination of FIG. 2, the port 21 will be above the lower edge of the gasket 35 so as to prevent communication between the tank 13 and the bore 20 leading to the outside. However, in the position shown, the valve stem 17 is depressed so that the bore 21 communicates with the tank 13. Propellent under pressure is supplied to the opening 59 and the annular space 60 and then flows both through the bore 20, out of the radial port 21; and into tank 13, and around stem portion 19, through gap 73 between stem 17 and mounting cup 39, deflecting diaphragm 35, and into the tank 13. It then flows past member 16 and then through holes 46. The pressure, which is typically approximately 800 psig, and cannot exceed 900 psig, forces sealing lip 76 away from the sides of the valve tank 13. The propellent then pressure fills into the container.

Sufficient medium, e.g., propellent, is filled in, based on the size of the container, to establish an operating pressure of 30 to 70 psig. Once the stem is allowed to return to its normal position, at the end of pressure filling after a measured amount has been filled in, flange 76 resumes its normal position sealing against the wall of the valve tank 13 to prevent propellent from reaching the tank area and escaping. The pressure within the container will act on the inside of the flange 76 to force the sealing lip 78 against the sides of the tank 13 to maintain a good seal.

Figure 2:
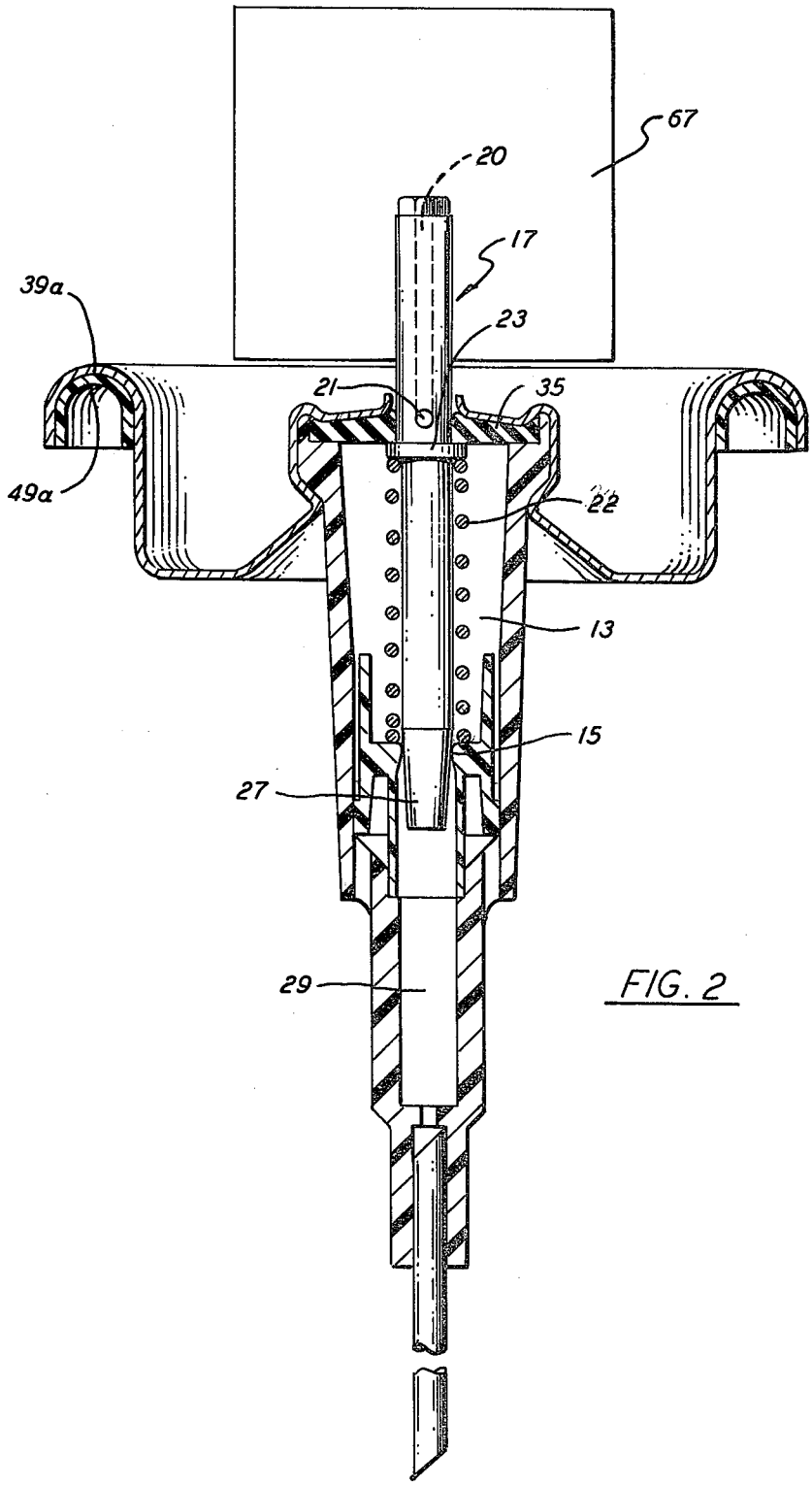
FIG. 2 is a cross-sectional view of a metering valve according to the present invention in the rest position.

The normal unoperated position of the metering valve is illustrated by the valve of FIG. 2. In the embodiment illustrated here, spring 22 is biasing stem 17 upward so that flange 23 is resting against diaphragm 35. As illustrated, the radial port 21 is now above diaphragm 35 so that no communication is established between outlet bore 20 and the tank 13. In the position shown, the taper 27 at the bottom portion 25 of valve stem 17 is separated from the throat 15 permitting material to pass from the chamber 29 into tank 13. When it is desired to discharge, stem 17 is pressed downward. As this occurs, the taper 27 will move below the throat 15 preventing any additional material from reaching the tank 13. Thereafter, port 21 will move below diaphragm 35 placing the outlet bore 20 in communication with tank 13. The material stored in tank 13, which will be under pressure, will then be forced out and dispensed.

Figure 3:
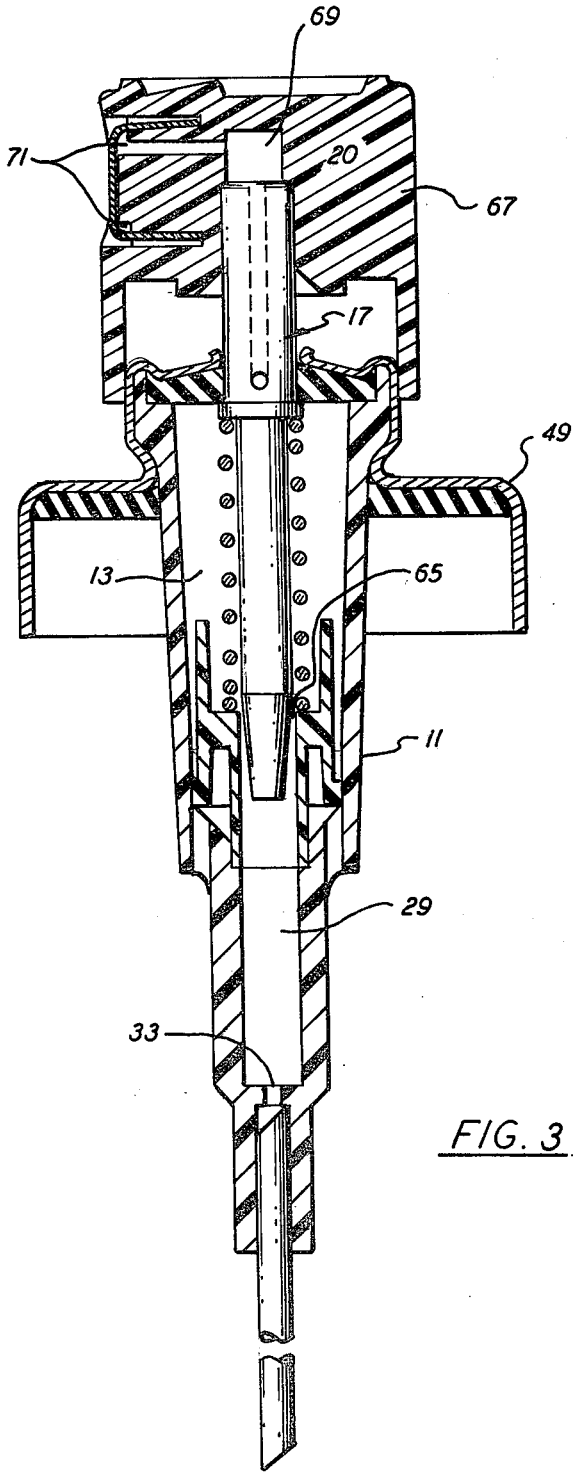
FIG. 3 is a cross-sectional view of a non-metering valve according to the present invention in the rest position.

A mounting cup **39*a* for crimping to the bead on a metal can with a sealant 49*a* between is shown with this embodiment. The embodiment just described is a metering valve. That is, the throat 15 closes off the tank 13 from the container when the stem 17 is depressed. FIG. 3 illustrates a non-metering valve having a construction identical to that of FIG. 2 with the one exception; it does not contain a throat 15 which the taper 27 bridges. Thus, there is at all times gap 65 between the valve body 11 and the valve stem 17 so that material in the chamber 29 can always reach the tank 13. This valve is also shown with an actuator 67 mounted on to the top portion 19 of the stem 17. Material expelled through the bore 20 enters a chamber 69 in the actuator from which it is then directed outward through channels 71** in conventional fashion.

Although, in this embodiment, during pressure filling, material can flow from the tank through the gap 65 into the chamber 29 and then through the orifice 33 into the container, advantages are still obtained with the present invention. The orifice 33 is a limiting orifice and in some types of valves is made quite small. In such cases, filling through this orifice could take an unduly long time. Thus, even with a standard valve, i.e., a non-metering valve, the present invention offers advantages in pressure filling.

What is claimed is:

1. In a pressurized dispenser comprising: a container; a mounting cup having a central opening therein, said mounting cup attached to said container; a dispensing means comprising a body member forming a tank and having an open top portion and a dispensing stem projecting therefrom through said central opening in said mounting cup and spaced from said opening to form a gap, said body retained in said mounting cup; and a diaphragm interposed between said body and said mounting cup, sealing around said projecting stem, the improvement comprising:

(a) a body member forming a chamber axially inward of said tank, said chamber having a diameter smaller than the diameter of said tank, said tank thereby having a bottom at the point where said chamber begins, at least one hole formed in said bottom radially outward of said chamber thereby forming a path to the inside of the container;

(b) a piston-like member inserted into said tank extending to the bottom thereof, said piston-like member having a flange extending axially inward terminating in a sealing lip sealing against the side of said tank at said bottom, said flange being radially flexible at said sealing lip, and an annular portion radially inward of said sealing lip forming a throat, said dispensing stem extending through said throat; and (c) a cylindrical member concentric with said flange sealed to and extending axially inwardly from said throat and engaging said chamber in a sealing manner so as to seal off an annular space between said flange and said cylindrical member, which space is in communication with said at least one hole, whereby during pressure filling, a gas admitted through the opening in said mounting cup and around said stem will flex said diaphragm, flow into said tank, and flex said flange radially inwardly to move said sealing edge from the side of said tank permitting flow through said at least one hole into the inside of the container.

2. The improvement according to claim 1 and further including a flange axially outward of said annular portion defining said throat having an outer diameter less than inner diameter of said tank.

3. The improvement according to claim 1, wherein said dispenser comprises an aerosol dispensing valve, said dispensing stem including a central bore therethrough and a radial port at the inside end of said bore, which, when in an at rest position, is above the bottom edge of said diaphragm and, when in an operated position, is in communication with said tank.

4. The improvement according to claim 3, wherein said aerosol valve comprises a metering valve, said throat adapted to seal against said stem when said stem is moved to a position where said radial port is below said diaphragm, said stem formed so as to be spaced from said throat when in the rest position.

5. The improvement according to claim 4, wherein said stem has a taper at its inner end.

6. The improvement according to claim 3, wherein said aerosol valve comprises a non-metering valve, a gap being established between said throat and said stem when said stem is in a position where said radial port is below said diaphram.

* * * * *